US006568933B1

(12) United States Patent
Guerra

(10) Patent No.: US 6,568,933 B1
(45) Date of Patent: May 27, 2003

(54) APPARATUS TO BURN GASES

(75) Inventor: Romeo E. Guerra, Plano, TX (US)

(73) Assignee: R. E. Guerra Enterprises Ltd., Plano, TX (US)

( * ) Notice: Subject to any disclaimer, the term of this patent is extended or adjusted under 35 U.S.C. 154(b) by 0 days.

(21) Appl. No.: 10/161,376

(22) Filed: Jun. 3, 2002

(51) Int. Cl.[7] ..... F23Q 9/08
(52) U.S. Cl. ..... 431/19; 431/281
(58) Field of Search ..... 431/19, 281, 354; 126/116 A

(56) References Cited

U.S. PATENT DOCUMENTS

| | | | | | |
|---|---|---|---|---|---|
| 815,316 | A | * | 3/1906 | Youngs | 431/19 |
| 2,197,904 | A | * | 4/1940 | Terry | 431/12 |
| 2,212,606 | A | * | 8/1940 | Klinker | 431/90 |
| 2,674,304 | A | * | 4/1954 | Trimble | 431/90 |
| 3,526,471 | A | * | 9/1970 | Corey | 431/19 |
| 4,218,426 | A | * | 8/1980 | Dahmen | 423/210 |
| 4,406,615 | A | | 9/1983 | Guerra et al. | |
| 4,906,175 | A | | 3/1990 | Guerra | |
| 5,158,442 | A | | 10/1992 | Guerra | |
| 5,390,855 | A | | 2/1995 | Mims et al. | |
| 5,470,227 | A | | 11/1995 | Mims et al. | |

* cited by examiner

*Primary Examiner*—Alfred Basichas
(74) *Attorney, Agent, or Firm*—Bracewell & Patterson, L.L.P.

(57) ABSTRACT

A pressure balance unit mounts to a combustion chamber having a fluctuating negative interior pressure. The unit has a housing inner portion mounted to the combustion chamber, the housing inner portion having an inner end located within the combustion chamber. The inner end has an opening that communicates the interior of the housing inner portion with the interior of the combustion chamber. A housing outer portion is located on an outer end of the housing inner portion. An annular intake is located between the housing inner and outer portions for drawing ambient air into the housing inner and outer portions. The intake and the opening in the housing inner portion have flow areas sized so as to balance pressure in the housing outer portion with pressure in the chamber. The intake is defined by a tapered outer end on the housing inner portion and a tapered inner end on an the housing outer portion. A pilot tube can extend from the pressure balance unit into the combustion chamber to light the burner. Alternately, a sensing tube can extend from the pressure balance unit into the combustion chamber for sensing characteristics of the gas in the chamber. In that case, the intake is adjusted to cause flow from the tube into the pressure balance unit.

19 Claims, 4 Drawing Sheets

APPARATUS TO BURN GASES

BACKGROUND OF THE INVENTION

1. Field of the Invention

This invention relates to a combustion chamber to burn gas, and more particularly to a pressure balance housing that mounts to the combustion chamber for use with a pilot or a sensor.

2. Description of Prior Art

A wide variety of apparatuses are currently used to burn gases. A common application involves burning fuel gases in main burners to inject heat into some process. For example, electrical power producers may burn natural gas to generate steam to drive electric generators. Refinery operators may use the heat in catalytic cracking units ("cat-crackers") to break up long hydrocarbon chains, or in distillation units to separate the various hydrocarbon constituents in crude oil. Refiners may also want to dispose of gaseous waste by-products by incinerating them. Manufacturers often use heat to prepare their raw or partially treated materials for the next step in their manufacturing process.

In many applications a burner is supplied with a fuel to cause a flame. The gasses to be burned are delivered to the combustion chamber for burning by the burner. A pilot is generally used to light the burner. The burner is typically located in an enclosure having a vent, such as a smokestack, to vent byproducts from the burning by creating negative pressure in the chamber. A blower in the vent may assist in creating the negative pressure. A recirculation conduit may return some of the byproducts for further burning. Various factors, such as the wind flowing across the upper end of the stack, the blower, the extent of recirculation, and natural convection can produce a variable low pressure region in the chamber. That low pressure can either directly or indirectly cause the burner and the pilot to go out. This is very unsafe because fuel may be supplied to the burner, or waste gases routed to the burner for disposal, but the gases do not ignite because of the extinguished pilot. That leads to an unsafe accumulation of fuel, or the failure to safely dispose of waste gases.

Also, in many cases it is desired to measure characteristics of the gas in the combustion chamber, such as its constituents, temperature, pressure, the presence of flame etc. This is not easily performed because of the high temperatures within the chamber.

SUMMARY OF THE INVENTION

The present invention uses a pressure balance unit mounted to the chamber. The unit includes a housing inner portion mounted to the combustion chamber, the housing inner portion having an inner end with an opening communicating with the interior of the combustion chamber. A housing outer portion is on an outer end of the housing inner portion. An annular intake is located between the housing inner and outer portions for drawing ambient air into the housing inner and outer portions. The intake and the opening in the housing inner portion have flow areas sized so as to balance pressure in the housing outer portion with pressure in the chamber.

A tube extends through the housing outer portion and has an open inner end in the combustion chamber. The tube has an orifice adjacent its inner end within the housing outer portion. A pilot may be incorporated with the tube, so that gas flows from the intake, through the orifice and into the combustion chamber, where it is ignited. The pressure balancing unit causes the pressure in the housing outer portion to fluctuate up and down in unison with pressure fluctuations in the chamber. This results in the air flow into the tube increasing and decreasing in response so reduce the chances for the pilot to go out.

Further, a sensor may be mounted in the tube outward of the orifice. In this case, the intake is adjusted so that the pressure in the housing outer portion is slightly less than the pressure in the chamber. This causes gas in the chamber to flow into the tube and out the orifice into the housing outer portion. The sensor monitors characteristics of the gas.

BRIEF DESCRIPTION OF THE DRAWINGS

So that the manner in which the described features, advantages and objects of the invention, as well as others which will become apparent, are attained and can be understood in detail, more particular description of the invention briefly summarized above may be had by reference to the embodiments thereof that are illustrated in the drawings, which drawings form a part of this specification. It is to be noted, however, that the appended drawings illustrate only typical preferred embodiments of the invention and are therefore not to be considered limiting of its scope as the invention may admit to other equally effective embodiments.

In the drawings.

DETAILED DESCRIPTION

Figure 1:
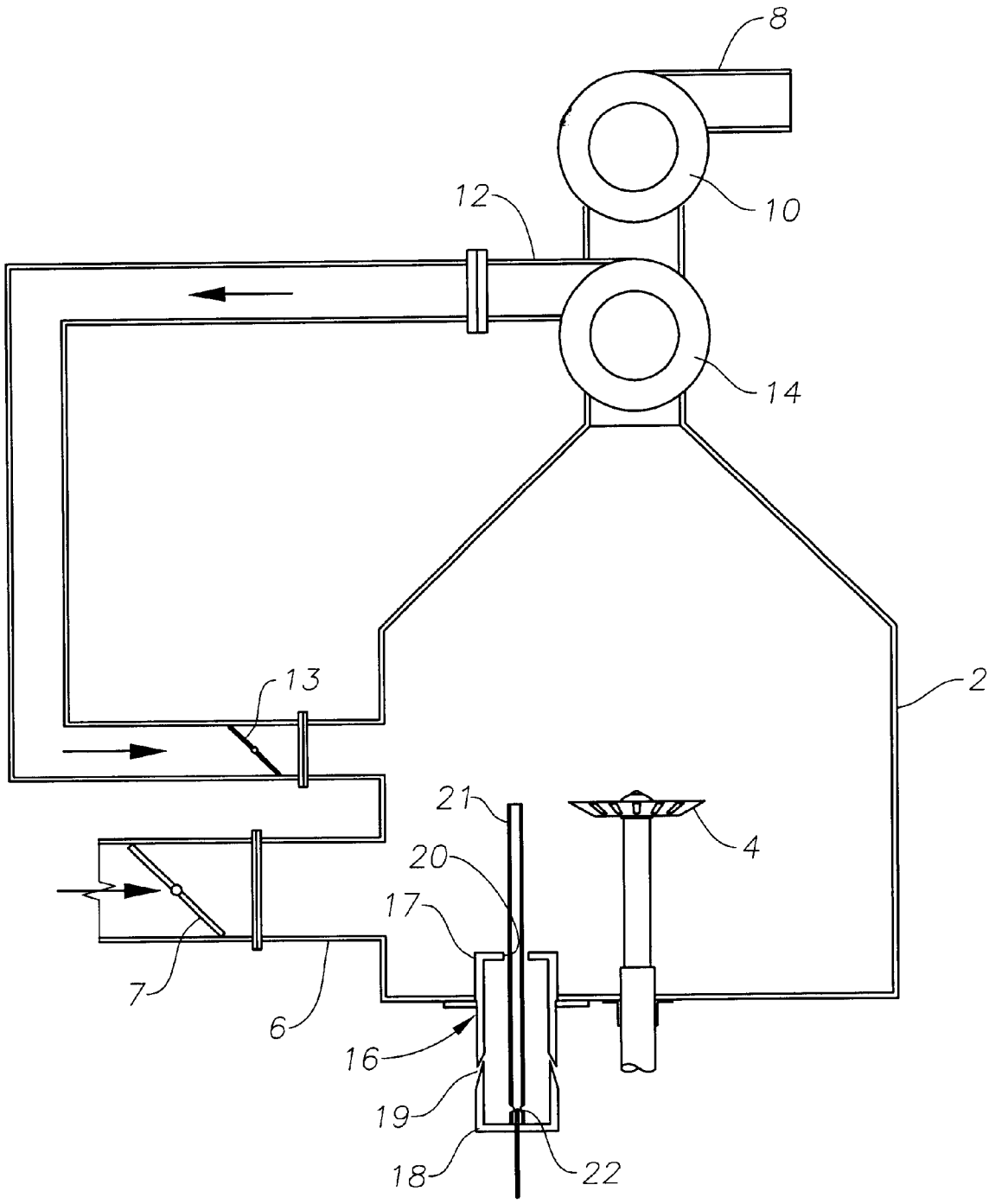
FIG. 1 is a schematic sectional view of a pressure balance unit mounted to a combustion chamber, the pressure balance unit being constructed in accordance with the present invention and shown with a pilot.

Referring to FIG. 1, a combustion chamber 2 for burning gases, particularly flue or waste gases, is schematically shown. Chamber 2 is an enclosure having a gas-fired burner 4 inside for burning gases flowing through an intake 6. Typically intake 6 will have a valve 7 to regulate the flow. The byproducts of combustion are drawn out a stack or vent 8, which optionally may have a blower 10 to increase an upward draft. Also, a recirculation conduit 12 may extend from vent 8 back into chamber 2 for recirculating a portion of the byproducts of combustion back for re-burning. A valve 13 will control the amount of recirculation flow.

The pressure in chamber 2 is less than the ambient pressure surrounding chamber 2. However, the chamber pressure may vary considerably depending upon intake flow rate and the degree of recirculation through recirculation conduit 13. Also the quality of the gas, such as the combustible portions and the amount of oxygen will vary. Consequently, burner 4 will not always stay lit, and will need to be repeatedly re-lit. There is a need to penetrate the combustion chamber to relight burner 4 as well as in some cases to sense the characteristics of the gas in chamber 2 and the presence of a flame at burner 4.

A pressure balance unit 16 is shown mounted to a wall of chamber 2 for enabling pressure balanced penetration into chamber 2. Pressure balance unit 16 comprises a two-part housing having a inner portion 17 that extends sealingly through an aperture into chamber 2. Part of inner portion 17 is also located on the exterior of chamber 2. Pressure balance unit 16 has an outer portion 18 located on the exterior of chamber 2 that joins to inner portion 17. An annular intake 19 is located between inner and outer portions 17, 18. Intake 19 is angled inwardly to draw ambient air into the interior of pressure balance units 16, 18. One or more holes 20 are located in the inner end of inner portion 17 to allow air flowing through intake 19 to flow into chamber 2.

Intake 19 is sized relative to hole 20 so that the pressure within pressure balance unit 16 will automatically track changes in pressure within chamber 2. This is accomplished in one manner by making intake 19 adjustable in cross-sectional flow area. While a negative pressure exists in chamber 2, the flow area of intake 19 is varied until the pressure within outer portion 18 outward of intake 19 equals the negative pressure in chamber 2. As the intake 19 flow area is increased, the pressure in outer portion 18 goes up relative to the pressure in chamber 2. Similarly, reducing the flow area of intake 19 causes the pressure in outer portion 18 outward of intake 19 to go down relative to the pressure in chamber 2. Once equalized, if the pressure in chamber 2 goes up, the pressure in outer portion 18 will go up correspondingly without any adjustment of intake 19. If the pressure in chamber 2 goes down, the pressure in outer portion 18 will go down correspondingly. Even though the pressure in outer portion 18 outward of intake 19 equalizes the pressure in chamber 2, there will be continuous airflow into intake 19 because the ambient pressure is greater. As the pressure in chamber 2 decreases, more air flows in through intake 19. As the pressure in chamber 2 increases, less air flows in through intake 19.

In the embodiment of FIG. 1, a pilot 21 is shown extending through pressure balance unit 16. Pilot 21 may be of a variety of types, and in this embodiment is supplied with gas for producing a flame to light burner 4. Pilot 21 has a mixing orifice 22 that draws air in that has passed through intake 19. Mixing orifice 22 is preferably slightly outward of intake 19. Hole 20 is not blocked by pilot 21. Pressure balancing unit 16 assures an adequate supply of clean air for pilot 21 that automatically increases and decreases with fluctuations in pressure in chamber 2. The air flowing through intake 19 flows into mixing orifice 22 and through pilot 21. Some air from intake 19 also flows through hole 20.

Figure 2:
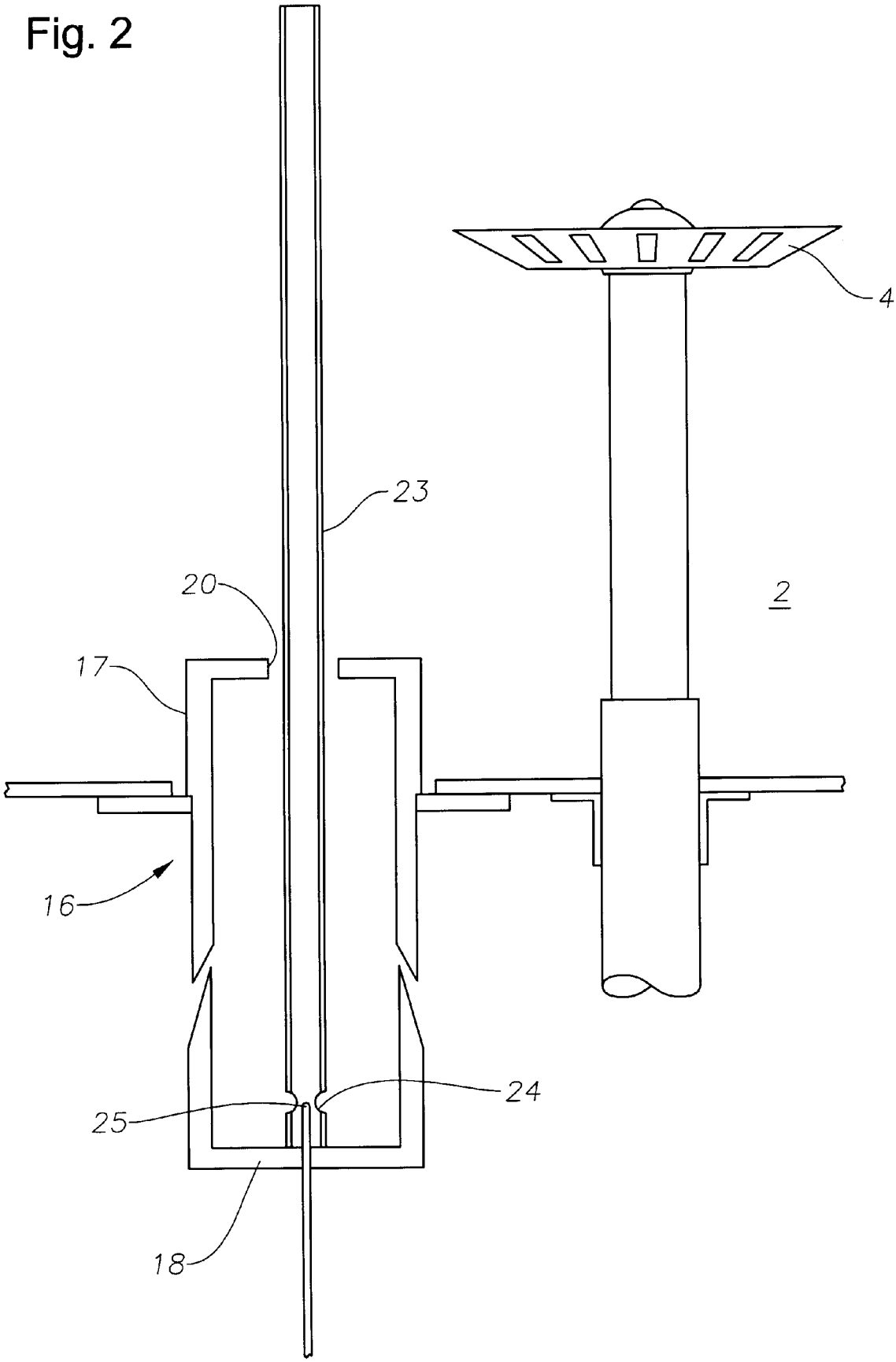
FIG. 2 is an enlarged sectional view of the pressure balance unit of FIG. 1, shown with a sensor tube.

In the embodiment of FIG. 2, rather than a pilot, a sensor tube 23 extends through pressure balancing unit 16. Sensor tube 23 has an open inner end and an orifice 24 in outer portion 18. Orifice 24 is also preferably located outward from intake 19. A sensor 25, such as one for sensing the constituents of a gas, the pressure, the temperature or the like, is located in tube 23 near orifice 24. The flow area of intake 19 is adjusted until the pressure in outer portion 18 becomes slightly less than the negative pressure in chamber 2. This results in a gas flow from chamber 2 into sensor tube 23 and out orifice 24, where the gas recirculates back through holes 20 into chamber 2. This arrangement brings a sampling of the gases in combustion chamber to sensor 25 for monitoring.

Figure 3:
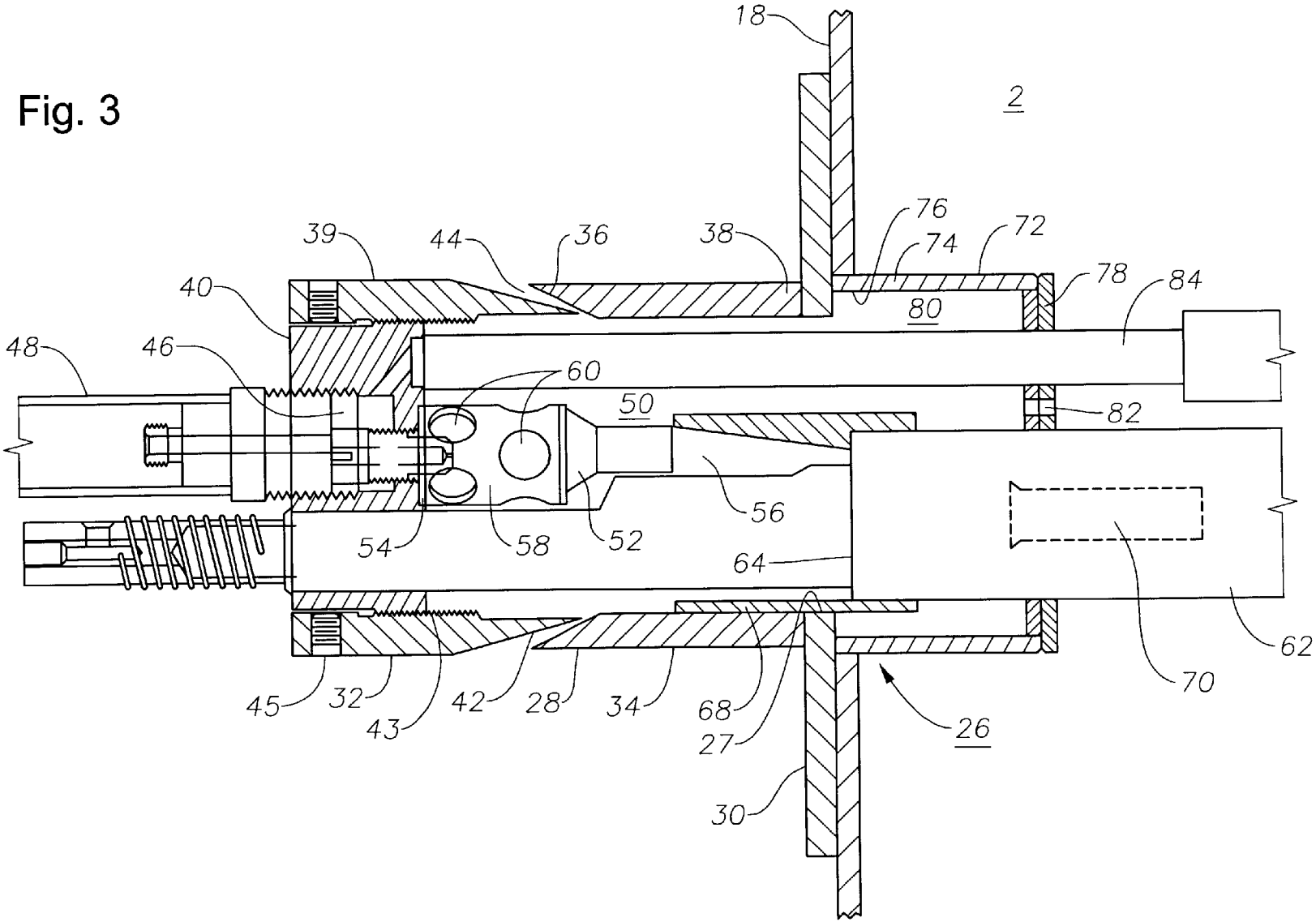
FIG. 3 is an enlarged sectional view of a more detailed embodiment of the pressure balance unit of FIG. 1, and shown with a pilot.

FIG. 3 shows a more detailed embodiment of pressure balancing unit16 of FIGS. 1 and 2, and shows it with an example of a pilot. Pressure balancing unit 26 comprises a housing 28 mounted to a divider 30, as shown in FIG. 2. Divider 30 can be the portion of the wall that makes up combustion chamber 2, but is preferably a plate adapted to be mounted to chamber 2 encircling an aperture 27 in chamber 2 with a corresponding opening preferably of approximately the same diameter as and aligned with aperture 27. In the embodiment shown, housing 28 is cylindrical and has an upstream or outer portion 32 and a downstream or inner portion 34. Downstream portion 34 is an open cylinder having an upstream end 36 and a downstream end 38. Downstream end 38 mounts to divider 30, surrounding aperture 27. Upstream end 36 is beveled such that it forms a circular conical surface. Upstream end 36 tapers radially inward in a downstream direction.

Upstream portion 32 is a cylinder having a cylindrical wall 39, a closed upstream end 40, and an open downstream end 42. Upstream portion 32 can be a unitary piece, but preferably closed upstream end 40 is a cylindrical plug onto which cylindrical wall 39 is adjustably mounted using threaded connection 43. Once adjusted, set screws 45 hold wall 39 fixed relative to upstream end 40. Downstream end 42 is beveled such that it forms a circular conical surface. Downstream end 42 also tapers radially inward in a downstream direction. While the angles of taper on upstream end 36 and downstream end 42 can vary, the angles of taper are preferably different. Thus, while downstream end 42 and upstream end 36 form a mating pair that defines an intake 44, their beveled surfaces are not necessarily parallel. This allows the size of intake 44 to vary as cylinder wall 39 screws onto or off of upstream end 40 of upstream portion 32. Preferably, the angle of taper of bevel 42 is less relative to the longitudinal axis than the angle of taper of bevel 36. Also preferably, the inner diameter of upstream cylindrical wall 39 at bevel 42 is slightly greater than the inner diameter of downstream portion 34 at bevel 36. Upstream end 40 of upstream portion 32 has an inlet port 46. An inlet pipe 48, through which a combustible gas flows, connects to inlet port 46 when pressure balance unit 26 is incorporated with a pilot.

Intake housing 28 defines a mixing chamber 50 in the interior region of intake housing 28. A mixing tube 52 is located in mixing chamber 50, passing approximately along the axial center of mixing chamber 50. Mixing tube 52 has an upstream end 54, a downstream end 56, and a cylindrical sidewall 58. Upstream end 40 of upstream portion 32 of intake housing 28 mounts to upstream end 54 of mixing tube 52. Upstream end 54 of mixing tube 52 is adapted to receive the source of combustible gas discharged from inlet port 46. Mixing tube 52 has a plurality of openings 60 in sidewall 58 to allow the air within mixing chamber 50 to enter mixing tube 52 and mix with the combustible gas therein. The gas mixture passes through downstream end 56 of mixing tube 52. Downstream end 56 passes through divider 30 through aperture 26.

A pilot tube 62 has an upstream end 64 and a downstream end 66 and is located within combustion chamber 2. Pilot tube 62 preferably mounts directly or indirectly to divider 30. In the embodiment of FIG. 2, pilot tube 62 is mounted to sleeve 68, which passes through aperture 26. Sleeve 68 mounts to divider 30 on the lower portion of aperture 26. Sleeve 68 also mounts to the lower portion of downstream portion 34 of intake housing 28. Downstream end 56 of mixing tube 52 mounts to the upper portion of sleeve 68 on its inner surface.

Upstream end 64 of pilot tube 62 is adapted to receive the downstream end 56 of mixing tube 52. The mixed gases issue from downstream end 56 of mixing tube 52 into upstream end 64 of pilot tube 62. An igniter 70 is located within pilot tube 62, preferably downstream of downstream end 56 of mixing tube 52. Igniter 70 is preferably an electrically actuated sparking device Downstream end 66 of pilot tube 62 is located near burner 16.

Figure 4:
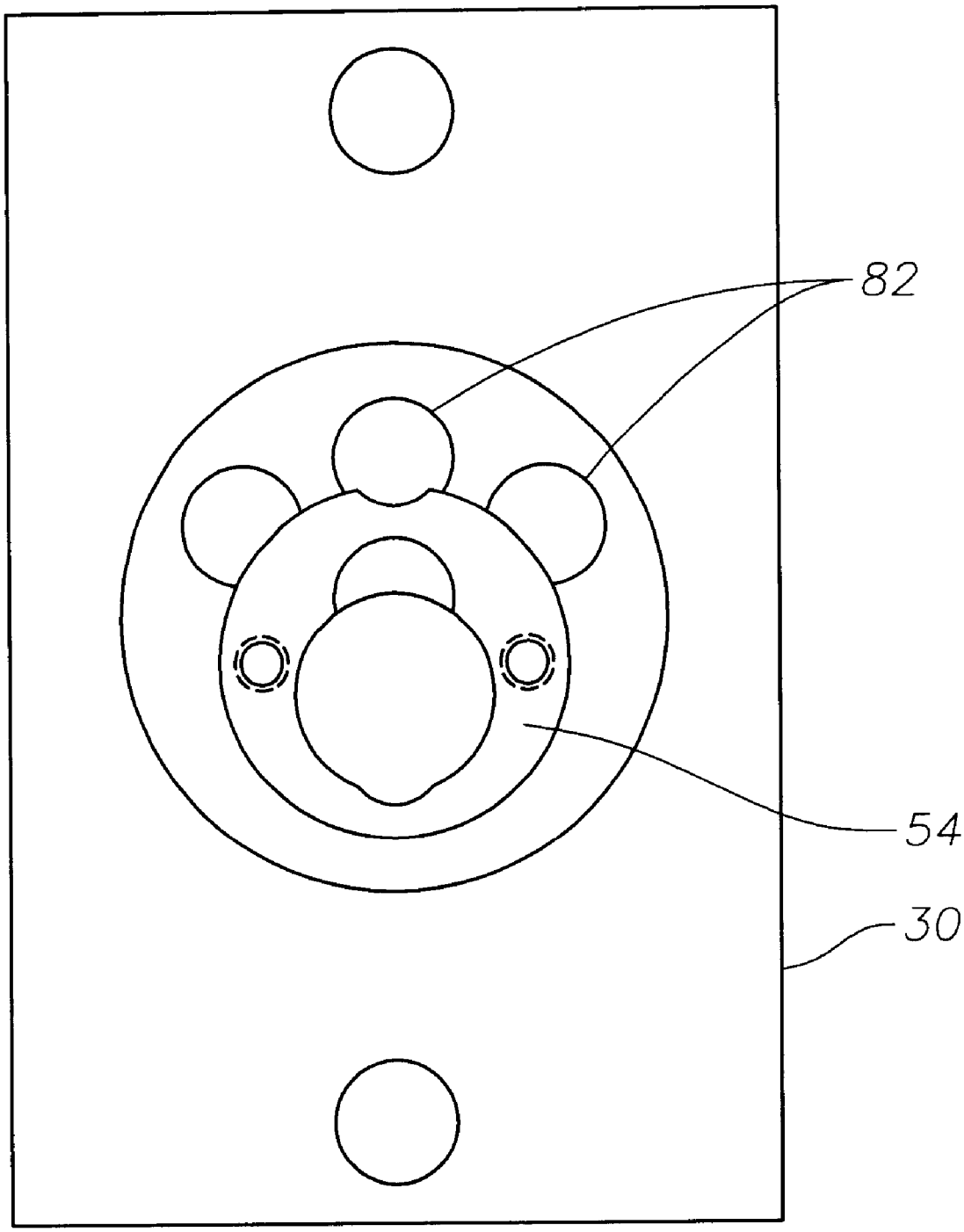
FIG. 4 is a rearward end view of the pressure balance unit of FIG. 3, with the inner components of the housing removed.

The inner portion 34 of housing 28 has an interior portion 72 that locates inside of combustion chamber 2. Interior portion 72 has a cylindrical wall 74, an open upstream end 76, and a closed downstream end 78. Upstream end 76 mounts to divider 30, surrounding aperture 26. Downstream end 78 has a plurality of holes 82 (FIG. 4), some of which allow passage of structural elements, while others allow essentially unrestricted fluid communication between combustion chamber 2 and the interior of housing 28. Pilot tube 62 passes through housing 28, exiting through downstream end 78 of interior portion 72.

FIG. 3 also shows an optional gas bypass tube 84 that connects to inlet port 46 and bypasses through mixing chamber 50. Bypass tube 84 extends through divider 30 via aperture 26, pressure chamber 80, and downstream end 78 of interior portion 72 via holes 82. Gas bypass tube 84 terminates in the vicinity of downstream end 66 of pilot tube 62. The gas in bypass tube 84 does not mix with air in mixing chamber 50.

In operation, the source gas provided to and issuing from burner 4 (FIG. 1) is ignited by the flame issuing from pilot tube 62. To produce a flame in pilot tube 62, a combustible gas is provided through inlet pipe 48 to inlet port 46, which discharges into mixing tube 52. The combustible gas mixes in mixing tube 52 with the air inside mixing chamber 50. The air in mixing chamber 50 enters mixing tube 52 through openings 60. The gas mixture continues downstream through mixing tube 52 to pilot tube 62. Inside pilot tube 62, the gas mixture is ignited by igniter 70. The burning gas issues as a flame from pilot tube 62.

The flow area of intake 44 is sized to cause the pressure in housing upstream portion 32 to be the same as in combustion chamber 2, which is less than ambient surrounding housing 28. Once the pressure is balanced, air will flow from ambient through intake 44, with some flowing out holes 82 and some flowing into mixing tube orifices 60. As the pressure in chamber 2 goes up and down, the pressure in upstream housing 32 will go up and down in unison. This increases and decreases the flow rate through intake 44 and into orifices 60, reducing chances for the flame on pilot tube 62 to go out.

The sizing of intake 44 may be calibrated in the factory. Unit 26 will be connected to a vacuum chamber and upstream housing portion 32 is rotated relative to downstream housing portion 34 to vary the flow area of intake 44 until the pressure in upstream housing portion 32 equals the pressure in the vacuum chamber. Once set, it does not require re-adjusting. Pressure balancing unit 26 may then be installed on a combustion chamber 2 at a different site.

Alternately, the flow area of intake 44 may set on site during actual operation of combustion chamber 2 by initially adjusting the flow area of intake 44 until the flame issuing from pilot tube 62 is the proper color. This adjustment is handled by rotating upstream portion 32 relative to downstream portion 34 while viewing the flame. Once properly adjusted, the pressure in mixing chamber 50 will remain the same as the pressure in upstream portion 32 and combustion chamber 2 regardless of changes in pressure in combustion chamber 2.

The flowing air into intake 44 does not disturb the pressure balance between the chamber of upstream housing portion 32 and combustion chamber 2. The separate chambers still seek equilibrium because of the fluid communication between them. Even though the pressure in combustion chamber 2 fluctuates, no further adjustment to intake 44 is needed. If the pressure in combustion chamber 2 drops, the pressure in mixing chamber 50 drops also, increasing air flow through intake 44. If the pressure in combustion chamber 2 increases, the pressure in mixing chamber 50 also increases, decreasing air flow through intake 44.

The fluid communication between mixing chamber 50 and combustion chamber 2 allows the pressures within those chambers to equalize. Because the pressure in mixing chamber 50 is equal to that in combustion chamber 2, the gases mixing in mixing tube 52 mix in the same pressure environment. Having no significant pressure differential between mixing chamber 50 and combustion chamber 2 tends to reduce the surge of mixed gas being forced through mixing tube 52 and pilot tube 62. This increases the likelihood of sustaining the flame issuing from pilot tube 62.

The present invention offers many advantages over the prior art. The balancing unit allows a pilot tube to operate better because its mixing tube orifice will be at substantially the same pressure as the interior of the combustion chamber. The balancing unit allows a sensor to be installed on the exterior of the chamber and sample gases from within.

While the invention has been particularly shown and described with reference to a preferred and alternative embodiment, it will be understood by those skilled in the art that various changes in form and detail may be made therein without departing from the spirit and scope of the invention.

What is claimed is:

1. A pressure balancing unit for mounting to a combustion chamber, comprising:

a housing inner portion adapted to be mounted to the combustion chamber, the housing inner portion having an inner end with an opening adapted to lead into the combustion chamber;

a housing outer portion on an outer end of the housing inner portion; and an annular intake located between the housing inner and outer portions for drawing ambient air into the housing inner and outer portions, the intake and the opening in the housing inner portion having flow areas adapted to be sized so as to balance pressure in the housing outer portion with pressure in the chamber.

2. The pressure balancing unit according to claim 1, wherein the intake is defined by a tapered outer end on the housing inner portion and a tapered inner end on the housing outer portion.

3. The pressure balancing unit according to claim 1, wherein the intake is defined by a tapered outer end on the housing inner portion and a tapered inner end on the housing outer portion, the tapered outer and inner ends being at different taper angles.

4. The pressure balancing unit according to claim 1, wherein the intake is defined by a tapered outer end on the housing inner portion and a tapered inner end on the housing outer portion, the tapered outer end being at a greater taper angle than the tapered inner end relative to a longitudinal axis of the housing inner and outer portions.

5. The pressure balancing unit according to claim 1, wherein the flow area of the intake is adjustable.

6. The pressure balancing unit according to claim 1, wherein the housing outer portion is secured by threads to the housing inner portion, and wherein rotating the housing outer portion relative to the housing inner portion causes the flow area of the intake to change.

7. The pressure balancing unit according to claim 1, further comprising a pilot extending from within the housing outer portion through the opening in the housing inner portion, the pilot having a mixing orifice located within the housing outer portion for drawing into the pilot air from the intake.

8. The pressure balancing unit according to claim 1, further comprising:

a sensor tube extending from within the housing outer portion through the opening in the housing inner portion;

a sensor mounted in the sensing tube, the sensor tube having an orifice located within the housing outer portion; and the flows areas of the intake and the opening in the inner housing are sized for causing flow of gas from the chamber into the sensor tube and out the orifice into the housing outer portion.

9. In a combustion chamber having a fluctuating negative interior pressure, the improvement comprising:

a housing inner portion mounted to the combustion chamber, the housing inner portion having an inner end located within the combustion chamber, the inner end having an opening that communicates the interior of the housing inner portion with the interior of the combustion chamber;

a housing outer portion on an outer end of the housing inner portion;

an annular intake located between the housing inner and outer portions for drawing ambient air into the housing inner and outer portions, the intake and the opening in the housing inner portion having flow areas sized so as to balance pressure in the housing outer portion with pressure in the chamber, the intake being defined by a tapered outer end on the housing inner portion and a tapered inner end on the housing outer portion, the tapered outer and inner ends tapering in an inward direction; and a tube extending from the housing outer portion through the outer end of the housing inner portion and into the combustion chamber, the tube having an open inner end and an orifice located in the housing outer portion so as to allow gas flow between the housing outer portion and the tube.

10. The combustion chamber according to claim 9 wherein the tapered outer and inner ends are at different taper angles.

11. The combustion chamber according to claim 10 wherein the tapered outer end is at a greater taper angle than the tapered inner end relative to a longitudinal axis of the housing inner and outer portions.

12. The combustion chamber according to claim 10, wherein the flow area of the intake is adjustable.

13. The combustion chamber according to claim 10, wherein the housing outer portion is secured by threads to the housing inner portion, and wherein rotating the housing outer portion relative to the housing inner portion causes the flow area of the intake to change.

14. The combustion chamber according to claim 10, wherein the tube comprises a pilot for lighting a burner located within the combustion chamber, the intake and opening in the inner end of the housing inner portion being sized so that the orifice in the tube draws into the pilot air from the intake.

15. The combustion chamber according to claim 10, further comprising:

a sensor mounted in the sensing tube outward from the orifice for sensing characteristics of gas within the chamber; and the flows areas of the intake and the opening in the inner end of the inner housing are sized for causing flow of the gas from the chamber into the sensor tube and out the orifice into the housing outer portion.

16. A method of burning gas within a combustion chamber, comprising the steps of:

(a) mounting a housing to the combustion chamber, the housing having an inner end with an opening communicating with the interior of the combustion chamber, the housing having an annular intake in communication with ambient air surrounding the housing;

(b) sizing flow areas of the intake and the opening in the inner end of the housing so as to balance pressure in the housing outward of the intake with pressure in the combustion chamber;

(c) burning combustible gas within the combustion chamber;

(d) venting the combustion chamber to create a negative pressure within the combustion chamber and within the housing outward of the intake, thereby causing air to flow into the intake.

17. The method according to claim 16, further comprising:

mounting a tube within the housing, the tube having an open inner end in the combustion chamber and an orifice in the housing;

flowing gas through the tube, mixing the gas with air drawn through the orifice, and igniting the gas to provide a pilot for a burner in the combustion chamber.

18. The method according to claim 17, further comprising:

mounting a tube within the housing, the tube having an open inner end in the combustion chamber and an orifice in the housing;

sizing the flow areas of the intake and the opening in the inner end of the housing to cause gas from the combustion chamber to flow into the tube and out the orifice; and mounting a sensor in the tube and sensing characteristics of the gas flowing through the tube.

19. The method according to claim 17, wherein step (b) comprises adjusting the flow area of the intake while negative pressure exists in the combustion chamber.

* * * * *